US008973414B2

(12) United States Patent
Bae et al.

(10) Patent No.: US 8,973,414 B2
(45) Date of Patent: Mar. 10, 2015

(54) LAUNDRY TREATING APPARATUS

(75) Inventors: Sang Hun Bae, Changwon-si (KR); Jung Wook Moon, Changwon-si (KR); Chul Jin Choi, Changwon-si (KR); Dong Hyun Kim, Changwon-si (KR); Young Bok Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 641 days.

(21) Appl. No.: 12/309,398

(22) PCT Filed: Jul. 18, 2007

(86) PCT No.: PCT/KR2007/003477

§ 371 (c)(1),
(2), (4) Date: Jan. 16, 2009

(87) PCT Pub. No.: WO2008/010670

PCT Pub. Date: Jan. 24, 2008

(65) Prior Publication Data

US 2009/0288456 A1 Nov. 26, 2009

(30) Foreign Application Priority Data

Jul. 18, 2006 (KR) ..... 10-2006-0067064
Jul. 18, 2006 (KR) ..... 10-2006-0067065
Jul. 18, 2006 (KR) ..... 10-2006-0067066

(51) Int. Cl.
*D06F 29/00* (2006.01)
*D06F 58/20* (2006.01)
(Continued)

(52) U.S. Cl.
CPC ..... *D06F 58/203* (2013.01); *D06F 58/20* (2013.01); *D06F 58/28* (2013.01); *D06F 39/007* (2013.01); *D06F 39/008* (2013.01)
USPC ..... 68/13 A; 68/5 C

(58) Field of Classification Search
CPC ..... D06F 58/203; D06F 39/02; D06F 39/007; D06F 39/008; D06F 39/022; D06F 39/088
USPC ..... 68/13 A, 5 R, 5 C; 8/149.3
See application file for complete search history.

(56) References Cited

U.S. PATENT DOCUMENTS 2,087,157 A * 7/1937 Lind ..... 141/2
2,209,487 A * 7/1940 Wagner ..... 210/662
(Continued)

FOREIGN PATENT DOCUMENTS

EP 1959043 A1 8/2008
KR 20-0320290 7/2003
(Continued)

*Primary Examiner* — David Cormier
(74) *Attorney, Agent, or Firm* — McKenna Long & Aldridge LLP

(57) ABSTRACT

A laundry treating apparatus and a method of controlling the same are disclosed. The laundry treating apparatus includes a laundry receiving unit for receiving laundry, a steam generator for generating steam to be supplied to the laundry receiving unit, a water supply unit for supplying water to the steam generator, a water softening member for softening water to be supplied to the steam generator, and a control unit for controlling the replacement or regeneration time of the water softening member to be displayed on a display unit. According to the present invention, it is possible to effectively prevent and/or remove wrinkles or rumples on laundry. Furthermore, it is possible to replace or regenerate a water softening member at an appropriate point of time, thereby increasing convenience in use.

16 Claims, 9 Drawing Sheets

(51) Int. Cl.
*D06F 58/28* (2006.01)
*D06F 39/00* (2006.01)

(56) References Cited

U.S. PATENT DOCUMENTS 3,250,392 A * 5/1966 Luck ..... 210/96.1
3,891,552 A * 6/1975 Prior et al. ..... 210/88
4,553,702 A * 11/1985 Coffee et al. ..... 239/690
5,377,496 A * 1/1995 Otto et al. ..... 62/129
2003/0196277 A1 10/2003 Hallman et al.
2004/0129032 A1 * 7/2004 Severns et al. ..... 68/5 C
2005/0138972 A1 * 6/2005 Park ..... 68/3 R

FOREIGN PATENT DOCUMENTS

KR 10-2006-0103002 9/2006
KR 10-2008-0029336 4/2008
WO WO 01/30229 5/2001
WO WO 2006101360 A1 * 9/2006
WO WO 2007145451 A2 * 12/2007

* cited by examiner

LAUNDRY TREATING APPARATUS

This application is a 35 USC §371 national stage entry of International Application No. PCT/KR2007/002477, filed on Jul. 18, 2007, and claims priority to Korean Patent Application No. 10-2006-0067064, filed Jul. 18, 2006; Korean Patent Application No. 10-2006-0067065, filed Jul. 18, 2006; and Korean Patent Application No. 10-2006-0067066, filed Jul. 18, 2006, all of which are hereby incorporated by reference herein in their entireties.

TECHNICAL FIELD

The present invention relates to a laundry treating apparatus and a method of controlling the same, and more particularly, to a laundry treating apparatus or a drying machine that is capable of removing or preventing wrinkles or rumples on laundry.

BACKGROUND ART

A laundry treating apparatus may be classified as a washing or drying machine for washing or drying laundry or a laundry refreshing machine for refreshing laundry. Here, refreshing laundry means the removal of moisture from the laundry, the removal of wrinkles or rumples from the laundry, the removal of static electricity from the laundry, or the removal of a smell from the laundry and the addition of perfume.

A drying machine is an electric home appliance that dries washed laundry, for example, washed clothes, using high-temperature air. Generally, the drying machine includes a drum for receiving an object to be dried, a drive source for driving the drum, a heating unit for heating air to be introduced into the drum, and a blower unit for suctioning or discharging air into or out of the drum.

Based on how to heat air, i.e., the type of the heating unit, the drying machine may be classified as an electric drying machine or a gas drying machine. The electric drying machine heats air using electric resistance heat. The gas drying machine heats air using heat generated by the combustion of gas.

In addition, the drying machine may be classified as a condensation type drying machine or a discharge type drying machine. In the condensation type drying machine, air, heat-exchanged with an object to be dried in a drum and changed into a high-humidity phase, is circulated without discharging the air out of the drying machine. Heat exchange is performed between an additional condenser and external air to produce condensed water, which is discharged out of the drying machine.

In the discharge type drying machine, air, heat-exchanged with an object to be dried in a drum and changed into a high-humidity phase, is directly discharged out of the drying machine. Based on how to put laundry in the drying machine, the drying machine may be classified as a top loading type drying machine or a front loading type drying machine. In the top loading type drying machine, an object to be dried is put in the drying machine from above. In the front loading type drying machine, an object to be dried is put in the drying machine from the front.

However, the conventional laundry treating apparatus with the above-stated construction has the following problems.

Generally, laundry, which has been already washed and spin-dried, is put in a drying machine such that the laundry is dried by the drying machine. However, the water-washed laundry is wrinkled according to the principle of water washing, and the wrinkles on the laundry are not completely removed during the drying process performed by the drying machine. Consequently, an additional ironing process is needed to remove wrinkles on a dried object, i.e., laundry which has been already dried by the conventional drying machine.

Furthermore, when clothes as well as washed laundry are normally stored and used, the clothes and the washed laundry may be wrinkled, crumpled, or folded (hereinafter, generally referred to as "wrinkled"). Consequently, there is a high necessity for an apparatus that is capable of easily and conveniently removing wrinkles on clothes during the normal use and storage of the clothes.

DISCLOSURE OF INVENTION

Technical Problem

An object of the present invention devised to solve the problem lies on a laundry treating apparatus that is capable of preventing and/or removing wrinkles on laundry and a method of controlling the same.

Technical Solution

The object of the present invention can be achieved by providing a laundry treating apparatus including a laundry receiving unit for receiving laundry, a steam generator for generating steam to be supplied to the laundry receiving unit, a water supply unit for supplying water to the steam generator, a water softening member for softening water to be supplied to the steam generator, and a control unit for controlling the replacement or regeneration time of the water softening member to be displayed on a display unit.

In another aspect of the present invention, provided herein is a laundry treating apparatus including a laundry receiving unit for receiving laundry, a steam generator for generating steam to be supplied to the laundry receiving unit, a water supply unit for supplying water to the steam generator, a water softening member for softening water to be supplied to the steam generator, a water softening detection unit for detecting whether water to be supplied to the steam generator has been softened, and a confirmation window for allowing a user to confirm the detection result of the water softening detection unit from the outside.

In another aspect of the present invention, provided herein is a drying machine including a drum for receiving laundry, the drum being selectively rotatable, a hot air heater for heating air to generate high-temperature hot air to be supplied to the drum, a steam generator for generating steam to be supplied to the drum, a water supply source for supplying water to the steam generator, a water softening member for softening water to be supplied to the steam generator, and a control unit for controlling the replacement or regeneration time of the water softening member to be displayed on a display unit.

In a further aspect of the present invention, provided herein is a drying machine including a drum for receiving laundry, the drum being selectively rotatable, a hot air heater for heating air to generate high-temperature hot air to be supplied to the drum, a steam generator for generating steam to be supplied to the drum, a water supply source for supplying water to the steam generator, a water softening member for softening water to be supplied to the steam generator, a water softening detection unit for detecting whether water to be supplied to the steam generator has been softened, and a confirmation window for allowing a user to confirm the detection result of the water softening detection unit from the outside.

Advantageous Effects

According to the present invention with the above-described construction, it is possible to effectively prevent and/or remove wrinkles on laundry. Furthermore, it is possible to replace or regenerate a water softening member at an appropriate point of time, thereby increasing the efficiency of a steam generator.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

MODE FOR THE INVENTION

Figure 1:
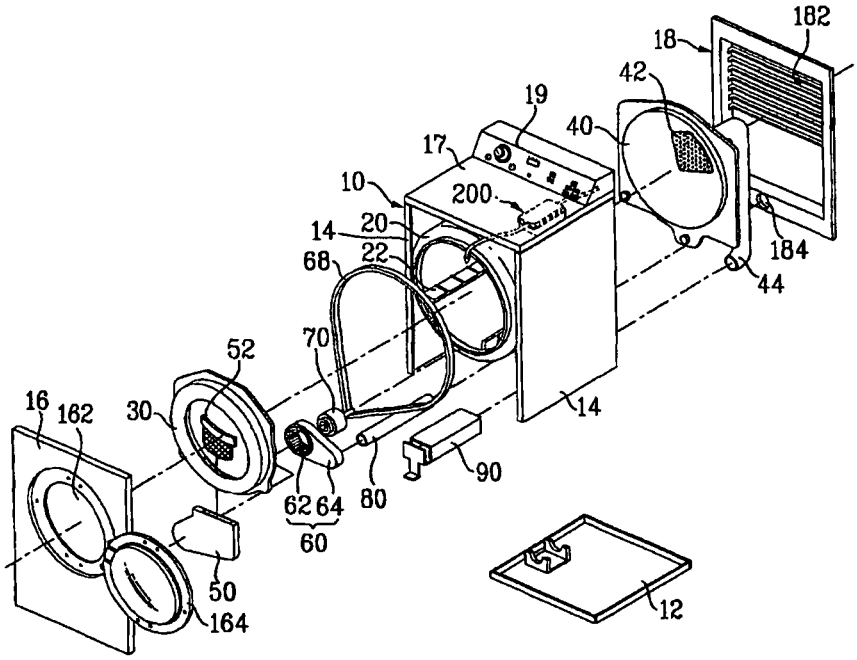
FIG. 1 is an exploded perspective view illustrating a laundry treating apparatus according to an embodiment of the present invention.

Reference will now be made in detail to the preferred embodiments of the present invention, examples of which are illustrated in the accompanying drawings.

Hereinafter, a front loading electrical condensation type drying machine will be described as an embodiment of the present invention in order to describe a laundry treating apparatus, especially a drying machine, according to the present invention and a method of controlling the same. However, the present invention is not limited to the above-specified drying machine, and therefore, it is also possible to apply the present invention to a top loading gas condensation type drying machine.

A laundry treating apparatus, especially a drying machine, according to an embodiment of the present invention and a method of controlling the same will be described with reference to FIGS. 1 and 2.

In a cabinet 10, forming the external appearance of the drying machine, are mounted a rotary drum 20, and a motor 70 and a belt 68 for driving the drum 20. At predetermined positions, in the cabinet 10, are mounted a heater 90 (hereinafter, referred to as a "hot air heater" for convenience of description) for heating air to generate high-temperature air (hereinafter, referred to as "hot air"), and a hot air supply duct 44 for hot air, generated by the hot air heater 90, into the drum 20. In the cabinet 10 are also mounted an exhaust duct 80 for discharging high-humidity air, heat-exchanged with an object to be dried in the drum 20, out of the drying machine, and a blower unit 60 for suctioning the high-humidity air. In addition, a steam generator 200, for generating high-temperature steam, is mounted at a predetermined position in the cabinet 10.

In this embodiment, an indirect drive system, in which the drum 20 is rotated using the motor 70 and the belt 68, is illustrated and described for convenience of description. However, the present invention is not limited to the indirect drive system. For example, the present invention may be applied to a direct drive system in which the motor is directly connected to the rear of the drum 20 such that the drum 20 is directly rotated by the motor.

In this embodiment, laundry is received in the drum 20. Consequently, a drying machine corresponding to this embodiment includes a laundry receiving unit formed in the shape of the drum 20. According to the present invention, however, the laundry receiving unit is not limited to the drum. In other words, any laundry receiving units will belong to the technical concept of the present invention so long as steam can be supplied into the laundry receiving units, in which laundry is received.

Now, the respective components of the drying machine will be described in detail.

The cabinet 10 forms the external appearance of the drying machine. The cabinet 10 includes a base 12 forming the bottom thereof, a pair of side covers 14 mounted vertically on the base 12, a front cover 16 and a rear cover 18 mounted at the front and rear of the side covers 14, respectively, and a top cover 17 located at the top of the side covers 14. A control panel 19, having various manipulation switches, is normally disposed at the top cover 17 or the front cover 16. To the front cover 16 is mounted a door 164. The rear cover 18 is provided with a suction unit 182, thrash which external air is introduced, and an exhaust hole 184, which is a final channel for discharging air in the drum 20 out of the cabinet 10.

The interior space of the drum 20 serves as a drying chamber in which a drying process is carried out. Inside the drum 20 are preferably mounted lifts 22 for lifting and dropping an object to be dried, such that the object turns over, to increase the drying efficiency.

On the other hand, a front supporter 30 and a rear supporter 40 are mounted between the drum 20 and the cabinet 10 (the front cover 16 and the rear cover 18). The drum 20 is rotatably mounted between the front supporter 30 and the rear supporter 40. Between the front supporter 30 and the drum 20 and between the rear supporter 40 and the drum 20 are mounted sealing members (not shown) for preventing the leakage of air, respectively. Specifically, the front supporter 30 and the rear supporter 40 enclose the front and the rear of the drum 20 to define the drying chamber. Also, the front supporter 30 and the rear supporter 40 serve to support the front and rear ends of the drum 20.

In the front supporter 30 is formed an opening, through which the drum 20 communicates with the outside of the drying machine. The opening is selectively opened and closed by the door 164. Also, a lint duct 50, which is a channel for discharging air in the drum 20 out of the drying machine, is connected to the front supporter 30. In the lint duct 50 is mounted a lint filter 52. One side of the blower unit 60 is connected to the lint duct 50, and the other side of the blower unit 60 is connected to the exhaust duct 80. The exhaust duct 80 communicates with the exhaust hole 184, which is formed in the rear cover 18. Consequently, when the blower unit 60 is operated, air in the drum 20 is discharged out of the drying machine through the lint duct 50, the exhaust duct 80, and the exhaust hole 184. At this time, foreign matter, such as fuzz, is filtered out by the lint filter 52. Generally, the blower unit 60 includes a blower 62 and a blower housing 64. The blower 62 is generally connected to the motor 70, which drives the drum 20.

In the rear support 40 is formed an opening 42 including a plurality of through-holes. The hot air supply duct 44 is connected to the opening 42. The hot air supply duct 44, communicating with the drum 20, serves as a channel for supplying hot air into the drum 20. Consequently, the hot air heater 90 is mounted at a predetermined position on the hot air supply duct 44.

Figure 3:
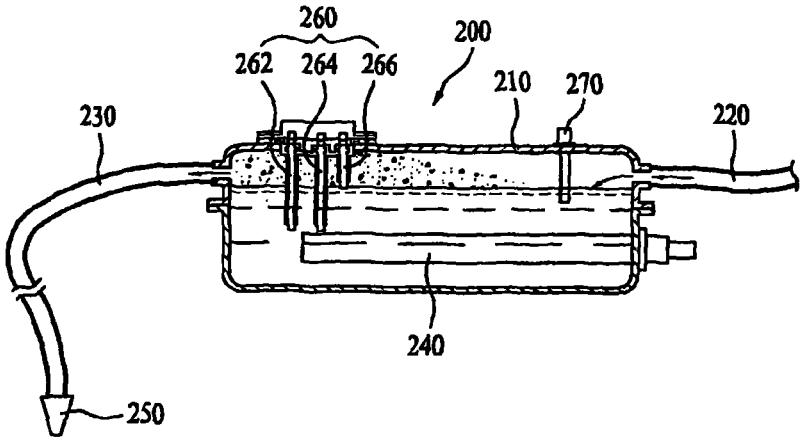
FIG. 3 is a sectional view illustrating a steam generator of FIG. 1.

On the other hand, the steam generator 200, for generating steam to be supplied into the drum 20, is mounted at a predetermined position in the cabinet 10. The details of the steam generator 200 will be described with reference to FIG. 3.

The steam generator 200 includes a water tank 210 for storing water, a heater 240 mounted in the water tank 210, a water level sensor 260 for sensing the water level in the steam generator 200, and a temperature sensor 270 for sensing the temperature in the steam generator 200. The water level sensor 260 includes a common electrode 262, a low water level electrode 264, and a high water level electrode 266. The water level sensor 260 senses a high water level or a low water level in the steam generator 200 based on the current conduction between the common electrode 262 and the high water level electrode 266 or the current conduction between the common electrode 262 and the low water level electrode 264.

To one side of the steam generator 200 is connected a water supply hose 220 for supplying water. To the other side of the steam generator 200 is connected a steam hose 230 for discharging steam. To the tip end of the steam hose 230 is preferably mounted a nozzle 250, which is formed in a predetermined shape. One end of the water supply hose 220 is connected to an external water supply source, such as a facet. The tip end of the steam hose 230 or the nozzle 250, i.e., the steam discharge port, is located at a predetermined position in the drum 20 for spraying steam into the drum 20.

Between the water supply hose 220 and the external water supply source may be mounted a valve (not shown) for selectively supplying water to the steam generator 200. The water supply hose 220 and the valve constitute a water supply unit for supplying water to the steam generator.

In this embodiment, on the other hand, the steam generator 200 is constructed in a structure in which a predetermined amount of water stored in the water tank 210, having a predetermined size, is heated by the heater 240 to generate steam (hereinafter, referred to as a "tub heating type steam generator" for convenience for description). However, the present invention is not limited to the above-specified steam generator. Consequently, the present invention may use any steam generator so long as the steam generator is capable of generating steam. For example, the steam generator 200 may be constructed in a structure in which the heater is directly mounted around the water supply hose, through which water passes, to heat water without storing the water in a predetermined space (hereinafter, referred to as a "pipe heating type steam generator" for convenience for description).

Now, a drying machine according to another embodiment of the present invention will be described with reference to FIG. 4.

In this embodiment, a water supply source 300, for supplying water to the steam generator, is detachably mounted to a steam generator 200. As in the previous embodiment, the water supply source may be a facet. In this case, however, the installation of the water supply source is very complicated. This is because water is not generally used in the drying machine, and therefore, when the facet is used as the water supply source, it is necessary to install various devices, which are annexed to the faucet.

In this embodiment, therefore, the detachable water supply source 300 is used. Specifically, the water supply source 300 is separated from the steam generator 200 so as to fill the water supply source 300 with water. After the water supply source 300 is filled with the water, the water supply source 300 is connected to the water supply channel of the steam generator 200, i.e., the water supply hose 220, which is very convenient.

Between the water supply source 300 and the steam generator 200 is preferably mounted a pump 400. The pump is preferably rotatable in forward and reverse directions. Consequently, it is possible to supply water to the steam generator, and, if necessary, it is possible to collect the remaining water from the steam generator 200. However, it is also possible to supply water to the steam generator 200 using water head difference between the water supply source 300 and the steam generator 200, not using the pump 400.

However, various components of the drying machine are normally standardized articles and designed in a compact structure, with the result that the structurally available space of the drying machine is absolutely insufficient. For this reason, the water supply using the water head difference is actually impossible if the size of various components of the conventional drying machine is not changed. Consequently, when the small-sized pump 400 is used, it is possible to install the steam generator 200 without the change in size of various components of the conventional drying machine. The use of the pump 400 is very beneficial. Also, the reason to collect the remaining water from the steam generator 200 is that the heater may be damaged due to the remaining water in the steam generator 200, or decomposed water may be hereafter used, if the steam generator 200 is not used for a long period of time.

The water supply unit for supplying water to the steam generator 200 includes the water supply source 300, which is detachably mounted to a machine body of the drying machine, an intermediate hose 490, the pump 400, and the water supply hose 220.

In the previous embodiment, water is supplied into the upper part of the steam generator 200, and steam is discharged from the upper part of the steam generator 200. In this embodiment, on the other hand, water is supplied into the lower part of the steam generator 200, and steam is discharged from the upper part of the steam generator 200. This structure is advantageous in collecting the remaining water from the steam generator 200. Also, a safety valve 500 is preferably mounted on a steam channel for discharging steam from the steam generator 200, i.e., a steam hose 230.

Hereinafter, the respective components of the drying machine will be described in detail.

Figure 5:
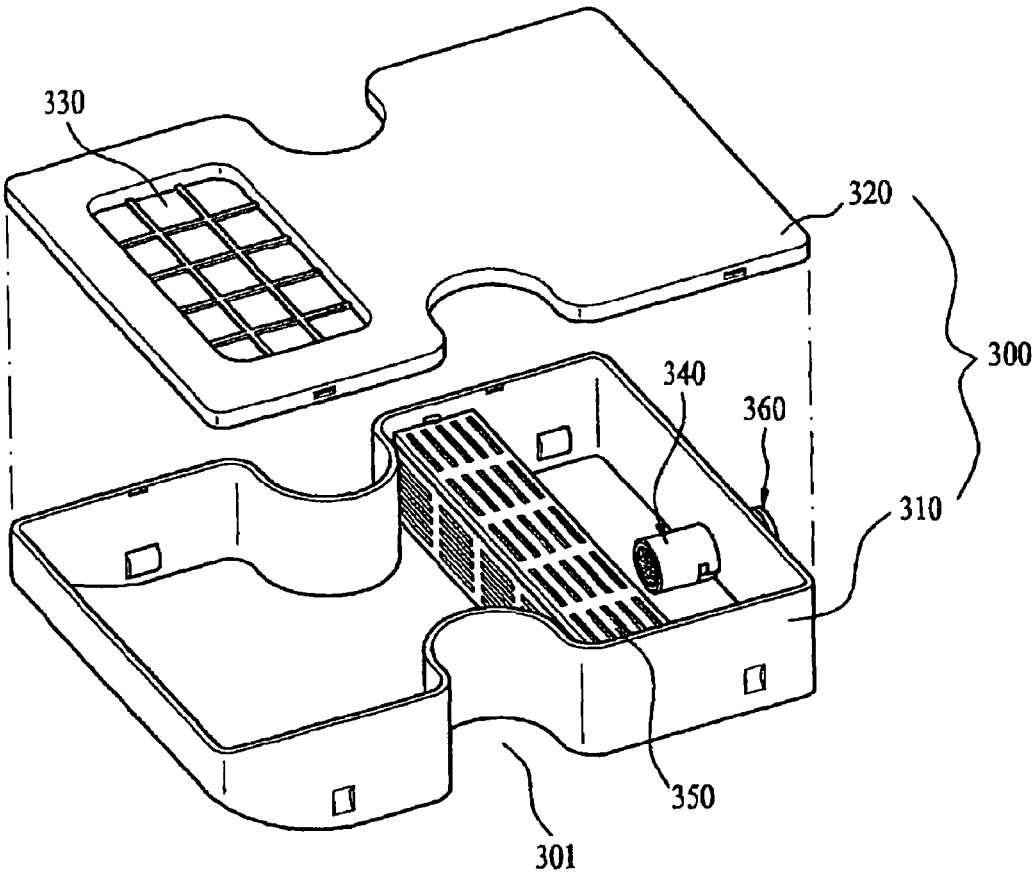
FIG. 5 is an exploded perspective view illustrating an example of a water supply source of FIG. 4.

First, the details of the detachable water supply source 300 (hereinafter, referred to as a "cartridge" for convenience of description) will be described with reference to FIG. 5.

The cartridge 300 including a lower housing 310 for storing water and an upper housing 320 detachably mounted to the lower housing 310. When the cartridge 300 is constructed in a structure including the lower housing 310 and the upper housing 320, it is easy to clean scale accumulating in the cartridge 300. In addition, it is easy to separate filters 330 and 340 and a water softening member 350 from the upper and lower housings and to clean or regenerate the separate filters 330 and 340 and the water softening member 350.

A first filter 330 is preferably mounted to the upper housing 320. Specifically, the first filter 330 is mounted in a water introduction part of the upper housing 320 for primarily filtering water when the water is supplied to the cartridge 300.

To the lower housing 310 is preferably mounted an opening and closing member 360 for selectively discharging water in the cartridge to the outside. Consequently, when the cartridge is separated from the drying machine, the water in the cartridge is not allowed to be discharged to the outside, and, when the cartridge is mounted in the drying machine, the water in the cartridge is allowed to be discharged to the outside. To the opening and closing member 360 is preferably mounted a second filter 340 for filtering water. More preferably, the second filter 340 is detachably mounted to the opening and closing member 360. By the provision of the first filter 330 and the second filter 340, it is possible to doubly filter out impurities, such as micro dust, from the water.

Figure 6:
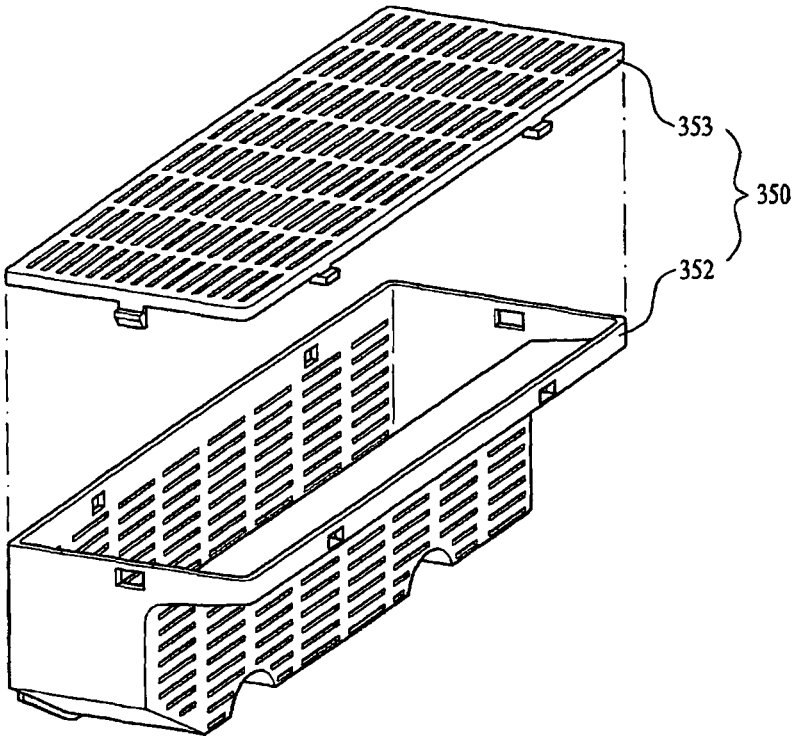
FIG. 6 is an exploded perspective view illustrating a water softening member of FIG. 5.

In the cartridge 300 is preferably mounted a water softening member 350 for softening water. More preferably, the water softening member 350 is detachably mounted in the cartridge 300. As shown in FIG. 6, the water softening member 350 includes a lower housing 352 having a plurality of through-holes and an upper housing 353 detachably mounted to the lower housing 352. The upper housing 353 has a plurality of through-holes. Preferably, a space defined between the upper housing 353 and the lower housing 352 is filled with ion-exchange resin (not shown).

However, the present invention is not limited to the above-specified water softening member or any specific water softening mechanism. In other words, the use of any water softening member that is capable of softening water belongs to the technical concept of the present invention.

The reason to use the water softening member 350 is as follows. When the hardness of water to be supplied to the steam generator 200 is high, lime, such as calcium carbonate ($CaCO_3$), may be separated as calcium hydrogencarbonate ($Ca(HCO_3)_2$), dissolved in the water, is heated, and the heater may be corroded by the lime.

Especially, water in Europe and the Americas is hard water having a high hardness. For this reason, the above-mentioned phenomenon may be serious. Consequently, it is preferable to previously remove calcium and magnesium ions, using ion-exchange resin, thereby preventing the separation of lime. The efficiency of the ion-exchange resin is lowered as the water softening process is carried out. Consequently, it is possible to regenerate the ion-exchange resin, using a salt solution (NaCl) such that the ion-exchange resin can be reused. For reference, the water softening process using the ion-exchange resin is represented by 2(R—SONa)+Ca2<->(R—SO)Ca+2Na, and the regenerating process of the ion-exchange resin is represented by (R—SO)Ca+2NaCl<->2(R—SONa)+CaCl.

In this embodiment, on the other hand, the water softening member 350 is mounted in the cartridge 300. However, the present invention is not limited to the above-specified structure. For example, the water softening member 350 may be mounted on the intermediate hose 490 or on the water supply channel 220. That is, it is possible to locate the water softening member 350 at any position in the water supply unit.

In other words, the water softening member 350 may be mounted in the cartridge 300 or at any position between the cartridge and the steam generator 200.

In this embodiment, on the other hand, the first filter 330, the second filter 340, and the water softening member 350 are mounted to the detachable cartridge 300. However, the present invention is not limited to the above-specified structure. For example, the present invention may be also applied to a case in which an external facet is used as the water supply source 300. In this case, it is preferable to mount at least one of the first filter 330, the second filter 340, and the water softening member 350 on the water supply channel, connected to the steam generator 200. Even in this case, it is more preferable to detachably mount the first filter 330, the second filter 340, and the water softening member 350 to the cartridge 300. Also, it is preferable that the first filter 330, the second filter 340, and the water softening member 350 are included in a single container, and the container is detachably mounted on the water supply channel.

As previously described, the efficiency of the water softening member 350, for softening water to be supplied to the steam generator 200, may be lowered with the passage of time or with the increase in frequency of use. Consequently, it is necessary to replace or regenerate the water softening member 350 at an appropriate point of time such that the water softening efficiency of the water softening member 350 is maintained.

This is because, when the water softening efficiency of the water softening member is lowered, the purpose of using the water softening member is not accomplished, with the result that calcareous scale accumulates in the steam generator, and therefore, the efficiency of the steam generator may be lowered, or the water supply channel 220 or the steam channel 230 may be clogged. Especially, it is preferable to remove scale, accumulating on the outer surface of the heater, from the heater, thereby maintaining the efficiency of the heater.

Consequently, the laundry treating apparatus, especially the drying machine, according to the present invention may include a control unit for controlling a display unit for displaying a replacement or regeneration time of the water softening member such that a user can be easily informed of the replacement or regeneration time of the water softening member.

Here, the replacement or regeneration time of the water softening member may be decided based on various factors.

As an example, the replacement or regeneration time of the water softening member may be decided based on the frequency of supply of water to the steam generator. Specifically, it is possible for the control unit to aunt the frequency of supply of water to the steam generator using the pump based on the frequency of opening and closing of the valve opened and closed to supply water to the steam generator from the external faucet.

Figure 2:
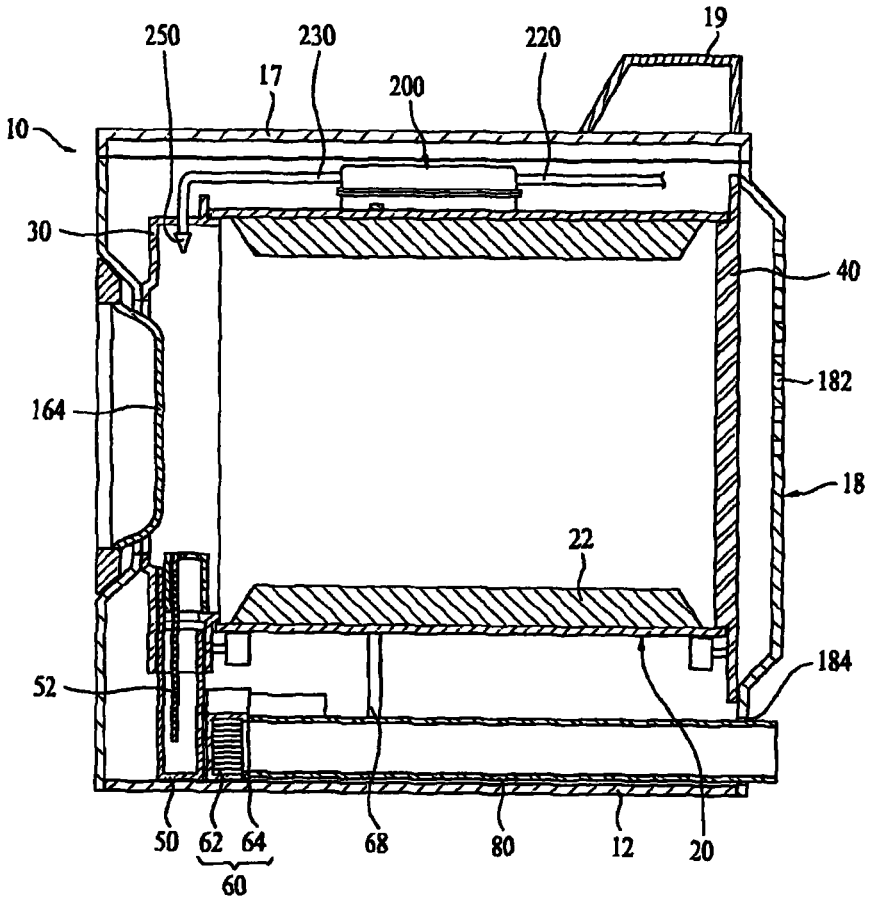
FIG. 2 is a vertical sectional view of FIG. 1.

Generally, the control unit (not shown) is mounted in the control panel 19 shown in FIG. 1. The operation of the laundry treating apparatus is controlled by the control unit. On the other hand, the display unit (not shown) is mounted on the front of the control panel for allowing a user to easily see the information displayed on the display unit.

As another example, the replacement or regeneration time of the water softening member may be decided based on whether a specific time has elapsed irrespective of whether the water softening member is used or not. Specifically, the control unit counts time until the replacement or regeneration of the water softening member is needed after the replacement or regeneration of the water softening member is completed. Consequently, the control unit decides that the replacement or regeneration of the water softening member is necessary when the specific time has elapsed.

As another example, the replacement or regeneration time of the water softening member may be decided based on the frequency of use of the steam generator. This may be carried out by counting the frequency of supply of electric current to the heater in the steam generator.

As a further example, the replacement or regeneration time of the water softening member may be decided based on the accumulated amount of water supplied to the steam generator through the water supply unit. Specifically, the replacement or regeneration time of the water softening member may be decided based on how mush water necessary to generate steam is supplied to the steam generator. When water contains a large amount of limestone, for example, it is possible to lower a reference value with respect to the accumulated amount of water. When water contains a small amount of limestone, on the other hand, it is possible to raise a reference value with respect to the accumulated amount of water.

The accumulated amount of water may be easily confirmed by the controller accumulatively counting the quantity of flow measured through a flow meter mounted between the water supply unit and the steam generator.

Figure 9:
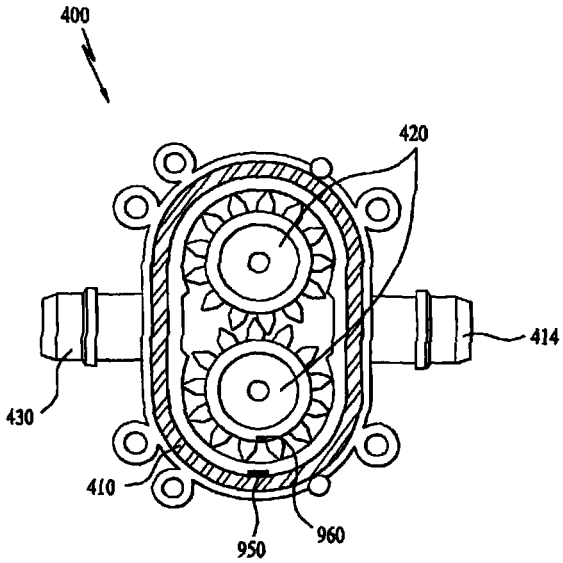
FIG. 9 is a sectional view schematically illustrating an example of a pump of FIG. 4.

On the other hand, the accumulated amount of water may be easily confirmed by a rotational frequency sensor 950 for sensing the rotational frequency of a gear unit of the pump 400, as shown in FIG. 9. Generally, the amount of water pumped by the pump may be decided in proportion to the rotational frequency of the gear unit. Consequently, when the rotational frequency of the gear unit is decided, it is possible to decide the amount of water supplied through the pump 400. As a result, it is possible to confirm the accumulated amount of water supplied to the steam generator through the pump by accumulatively counting the rotational frequency of the gear unit. That is, it is possible to easily confirm the accumulated amount of water supplied to the steam generator by the control unit accumulatively counting the rotational frequency of the gear unit sensed by the rotational frequency sensor 950.

The rotational frequency sensor 950 may sense the change of magnetic flux according to the rotation of a magnet 960 formed at a predetermined position of the gear unit to easily sense the rotational frequency of the gear unit. For example, the rotational frequency sensor 950 may by a hole sensor.

On the other hand, the replacement or regeneration time of the water softening member is decided by the control unit counting time or frequency. Consequently, the counted time or the counted frequency is preferably reset to an initial value after the replacement or regeneration of the water softening member is completed. Here, the initial value may be "0". The reset may be accomplished by sensing the attachment or detachment of the water softening member under the control of the control unit. Alternatively, an additional reset button (not shown) may be mounted on the control panel 19 such that the reset is accomplished by pressing the reset button.

For example, when the frequency of use of the steam generator is "100", and the replacement or regeneration of the water softening member is needed, the control unit displays that the replacement or regeneration of the water softening member is needed through the display unit. When a user replaces or regenerates the water softening member, the displayed information disappears from the display unit, the counted frequency of use of the steam generator is reset, and the frequency of use of the steam generator is newly counted.

The control unit may further include a memory for storing the frequency of use of the steam generator. The memory may be easily realized by using electrical erasable programmable read only memory (EEP-ROM). On the other hand, an additional battery (not shown) may be included for preventing the memory from being reset to the initial value when a power source is interrupted.

Hereinafter, examples of the display unit for displaying the replacement or regeneration time of the water softening member will be described in detail with reference to FIGS. 7A to 7C.

Figure 7:
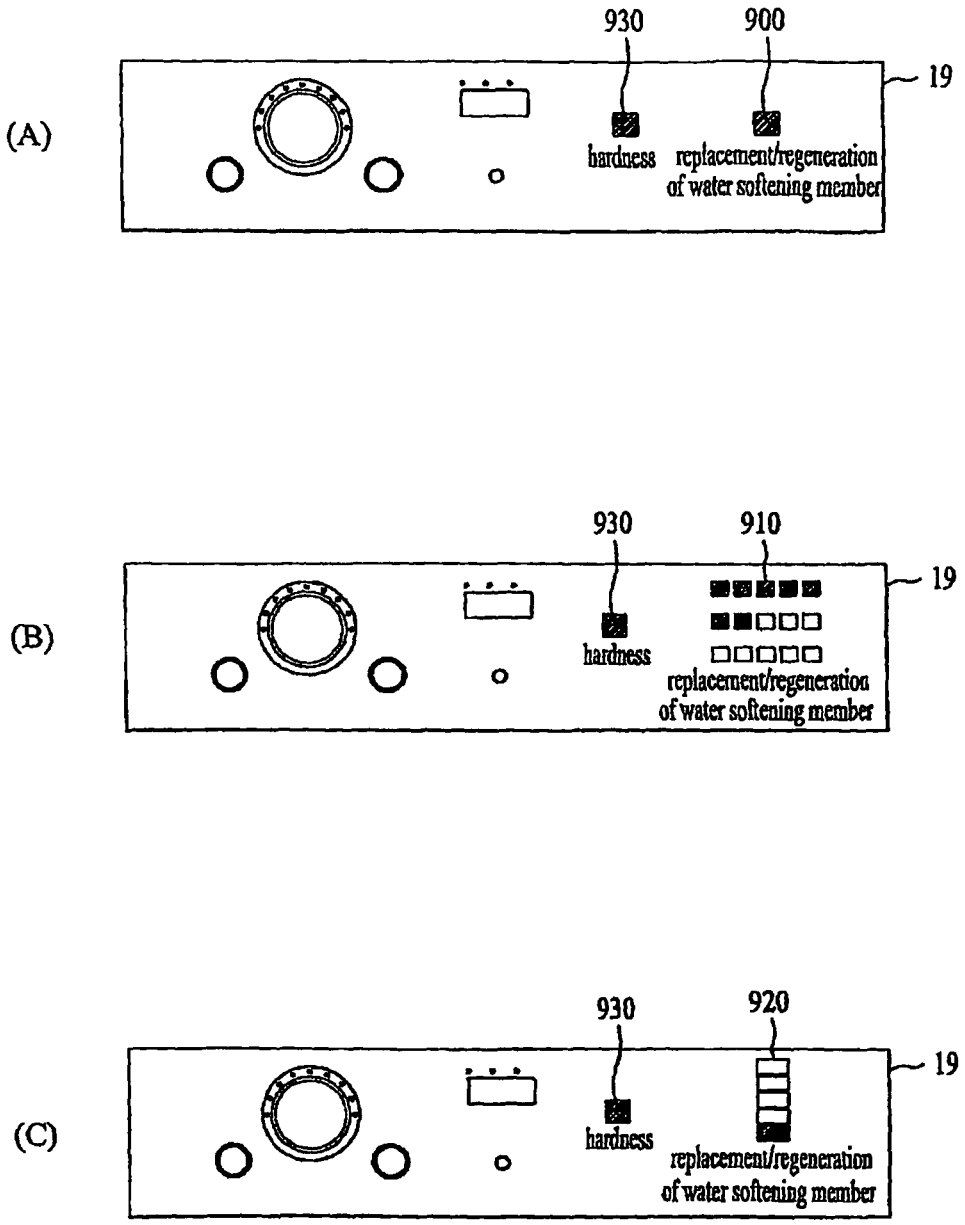
FIGS. 7A to 7C are front views illustrating examples of a display unit for displaying a replacement or regeneration time of the water softening member, which is applied to the present invention.

Referring to FIG. 7A, the display unit displays only the replacement or regeneration time of the water softening member. Specifically, when time, frequency, or the accumulated amount of water, counted by the control unit, exceeds a predetermined value, the display unit 900 displays that the replacement or regeneration of the water softening member is needed. This may be easily realized by lighting a light emitting diode (LED). The display unit 900 may be disposed at one side of the control panel 19. Of curse, the display unit 900 may also generate a predetermined sound to easily inform a user that the replacement or regeneration of the water softening member is needed.

Referring to FIG. 7B, the display unit displays remaining time, remaining frequency, or the remaining amount of water available as well as the replacement or regeneration time of the water softening member. Specifically, the number of LEDs constituting the display unit 910 is increased as time, frequency, or the amount of water supplied is accumulated. When time or frequency, counted by the control unit, exceeds a predetermined value, all the LEDs of the display unit 910 are lit. Of course, all the LEDs of the display unit 910 are initially lit, and all the LEDs of the display unit 910 are blinked when time or frequency, counted by the control unit, exceeds the predetermined value.

Consequently, a user can be easily informed that the replacement or regeneration of the water softening member is necessary after how much time or how many frequencies has elapsed as well as the replacement or regeneration time of the water softening member. Also, the user can be easily informed that the replacement or regeneration of the water softening member is necessary after how much water is further supplied. On the other hand, it is possible to construct the display unit 910 such that the user can be aware of time or frequency assigned to the lighting of each LED.

In addition to the above-described display pattern, it is possible to display the replacement or regeneration time of the water softening member with a percentage of 100 and to increase the percentage with the accumulation of the time or the frequency. For example, on the assumption that the replacement or regeneration of the water softening member is needed when the frequency of use of the steam generator is 100, 50% of the LEDs may be lit on the display unit 910 when the frequency of use of the steam generator is 50.

The display unit shown in FIG. 7C is identical to the display unit shown in FIG. 7B except that the display unit 920 is formed in the shape of a bar graph. Consequently, the bar graph is raised as time, frequency, or the amount of water supplied is accumulated. When the time, frequency, or the amount of water supplied exceeds a predetermined value, the bar graph is fully raised. Consequently, it is possible for a user to be easily informed of the replacement or regeneration time of the water softening member.

On the other hand, the above-described replacement or regeneration time of the water softening member does not directly represent when the replacement or regeneration of the water softening member is needed. In other words, the replacement or regeneration time of the water softening member is indirectly represented through a predetermined time or frequency. Consequently, the time or the frequency may be large or small depending upon the status of water at a site to which the present invention is applied. For example, the replacement or regeneration of the water softening member may be needed even in a short time or small frequency of use in a region where the hardness of water is very high. On the other hand, the replacement or regeneration of the water softening member may be unnecessary even over a long time or large frequency of use in a region where the hardness of water is very low. Of course, the deviation in the replacement or regeneration time of the water softening member may be reduced depending upon how the initial value is set.

Consequently, the drying machine according to the present invention may further include a hardness sensor (not shown) for directly sensing the water softening efficiency of the water softening member and displaying the replacement or regeneration time of the water softening member.

The hardness sensor measures the content of minerals in wash water. For example, the hardness sensor measures the content of mineral matter, such as magnesium ions (Mg+) and calcium ions (Ca+), in the wash water. Consequently, it is possible to easily confirm whether water is softened into a satisfactory state thrash the water softening member by using the hardness sensor.

On the other hand, the hardness sensor measures the magnitude of conductivity changed depending upon the amount of ions contained in the water. Consequently, a conductivity sensor may be used as the hardness sensor. The amount of ions contained in the water is decided based on the conductivity sensed by the conductivity sensor.

The hardness sensor is preferably mounted between the water softening member 350 and the steam generator 200. When the hardness of water sensed by the hardness sensor exceeds a reference value, the control unit preferably displays that the hardness of water is greater than the reference value through the display unit.

When the hardness of water sensed by the hardness sensor exceeds the reference value, for example, it is displayed through a hardness display unit 930, shown in FIGS. 7A, 7B, and 7C, that the water softening member cannot sufficiently perform the water softening function.

Of course, this display may be realized by an LED or a sound under the control of the control unit.

Hereinafter, another example for informing about the replacement or regeneration time of the water softening member, which is applied to the present invention, will be described with reference to FIG. 8.

Figure 4:
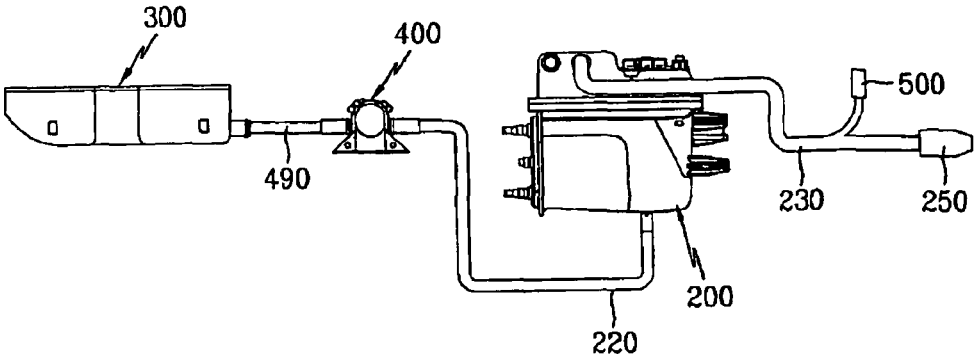
FIG. 4 is a view illustrating a steam generator of a laundry treating apparatus according to another embodiment of the present invention.
Figure 8:
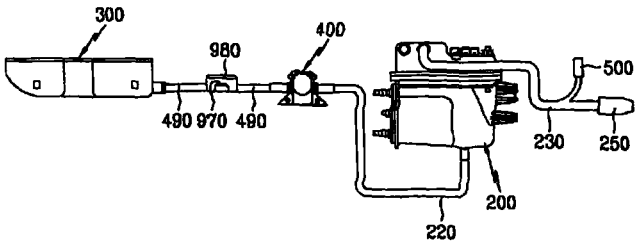
FIG. 8 is a view illustrating another example for informing about a replacement or regeneration time of the water softening member, which is applied to the present invention.

FIG. 8 is a structural view illustrating a water softening detection unit for detecting whether water to be supplied to the steam generator shown in FIG. 4 has been softened.

Referring to FIG. 8, this embodiment includes a water softening detection unit 970 for detecting the degree of softening of water to be supplied to the steam generator and a confirmation window 980 for allowing a user to confirm the detection result of the water softening detection unit 970 from the outside such that the user can be easily informed about the replacement or regeneration time of the water softening member.

Specifically, this embodiment includes the water softening detection unit 970 and the confirmation window 980 instead of the display unit and the control unit for controlling the display unit, which are included in the previous embodiment. Consequently, it is possible for a user to confirm the water softening detection unit 970 through the confirmation window 980, and therefore, the user is easily informed about the replacement or regeneration time of the water softening member.

The water softening detection unit 970, for detecting the degree of softening of water, is located as shown in FIG. 8.

According to the present invention, as shown in FIG. 8, the water softening detection unit 970 may be located at any position on the water supply channel between the water supply unit and the steam generator. Specifically, the water softening detection is possible as long as water passes through the water softening detection unit 970 before the water, having passed through the water softening member 350, is supplied to the steam generator.

Of course, it is not necessarily needed for the water, having passed through the water softening detection unit 970, to be supplied to the steam generator. For example, the water softening detection unit 970 may be located at the end of a branch pipe (not shown) diverging from the water supply channel 220.

Preferably, however, the water softening detection unit 970 is mounted between the water softening member 350 and the pump 400. This is because water does not flow before the pump 400 is driven, and therefore, it is possible to detect PH of the water more accurately.

The water softening detection unit 970 may be a PH sensor the color of which is changed depending upon the PH degree of water such that a user can easily determine whether the water has been softened. More specifically, the PH sensor may be a PH paper.

When water contains a large amount of limestone, the water exhibits basicity. Consequently, the water exhibits neutrality after the water is satisfactorily softened. When it is detected through the PH paper whether the water has been softened, on the other hand, the degree of softening of the water is easily detected according to the change in color of the PH paper.

When water exhibits basicity, for example, the color of the PH paper is changed to yellowish green or celadon green. As the basicity of the water is increased, the color of the PH paper is changed to celadon green. When water exhibits acidity, on the other hand, the color of the PH paper is changed to red or yellow. As the acidity of the water is increased, the color of the PH paper is changed to red. Consequently, when the color of the PH paper is changed to yellow, a user determines that the water is satisfactorily softened by the water softening member. Also, when the color of the PH paper is changed to yellowish green or celadon green, the user determines that the water is not satisfactorily softened by the water softening member.

Consequently, it is possible for the user to easily confirm the replacement or regeneration time of the water softening member based on the change in color of the PH paper.

On the other hand, it is preferable for the user to easily confirm the result detected by the water softening detection unit through the confirmation window. Consequently, the water softening detection unit is preferably located inside the confirmation window 980 such that the user can see the water softening detection unit through the confirmation window 980 from the outside. For this reason, the confirmation window 980 is preferably a visible window.

A position, the most easily accessible by a user, may be the control panel 19 of the laundry treating apparatus. Consequently, the confirmation window 980 is preferably located at the front of the control panel 19 shown in FIG. 1.

The details of the pump 400, which is applied to the present invention, will be described with reference to FIG. 9.

The pump 400 serves to selectively supply water to the steam generator 200. Specifically, the pump 400 is rotated, in a forward or reverse direction, to supply water to the steam generator 200 or collect the remaining water from the steam generator 200.

The pump 400 is preferably a gear-type pump so as to perform the above-described function. FIG. 9 illustrates a gear-type pump 400 as an example of the pump 400. The gear-type pump 400 includes a pair of gears 420 disposed in a case 410. The case 410 is provided with an inlet port 430 and an outlet port 414. Specifically, water is discharged from the inlet port 430 to the outlet port 414 or from the outlet port 414 to the inlet port 430 depending upon the rotating direction of the gears 420.

Figure 10:
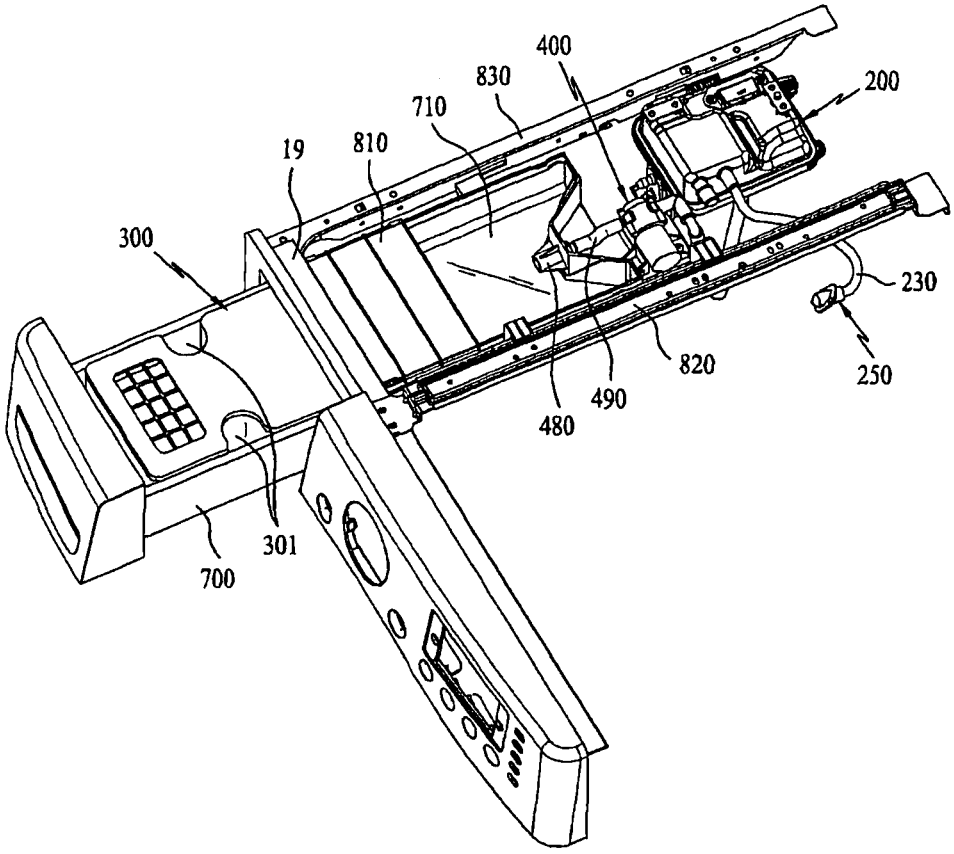
FIG. 10 is a perspective view illustrating an installation example of components of FIG. 4.

Hereinafter, an installation example of components of a steam line, including the steam generator according to the present invention, will be described with reference to FIG. 10.

At a predetermined position, in the drying machine, is mounted a drawer-type container (hereinafter, referred to as a "drawer") 700 that can be inserted and withdrawn. Preferably, the cartridge 300 is mounted in the drawer 700. Specifically, the cartridge 300 is not directly connected to a connection port 480. The cartridge 300 is mounted in the drawer 700, and the drawer 700 is inserted and withdrawn such that the cartridge 300 is indirectly coupled to and separated from the connection port 480.

Preferably, the drawer 700 is located at the front of the drying machine, for example, at the control panel 19. More specifically, a supporter 820 is mounted at the rear of the control panel 19. The supporter 820 is arranged approximately in parallel with a top frame 830. To the supporter 820 and the top frame 830 are mounted a drawer guide 710 for guiding and supporting the drawer 700. Preferably, a top guide 810 is mounted at a portion of the top of the drawer guide 710.

The top and one side (the front of the drying machine) of the drawer guide 710 are open. The drawer 700 is inserted and withdrawn through the side opening of the drawer guide 710. The connection port 480 is located at the top of the drawer guide 710 at the other side of the drawer guide 710.

As described above, it is preferable to install the drawer 700 at the front of the drying machine in consideration of convenience in use. FIG. 10 illustrates the control panel 19 installed at the front cover of the drying machine. Consequently, the drawer 700 is inserted into and withdrawn from the control panel 19. However, the present invention is not limited to the above-specified structure. For example, when the control panel is mounted at the top cover of the drying machine, as shown in FIG. 1, the drawer 700 may be directly mounted at the front cover of the drying machine.

When the cartridge 300 is mounted in the drawer 700, on the other hand, it is preferable that at least opposite sides of the cartridge 300 correspond in shape to those of the drawer 700, and therefore, the cartridge 300 is tightly coupled to the drawer 700. At the opposite sides of the cartridge 300 are preferably formed concave parts 301 for allowing a user to mount and separate the cartridge 300 in and from the drawer 700.

Hereinafter, a method of supplying water to the cartridge 300 will be described in detail with reference to FIG. 10.

When a user withdraws the drawer 700, the cartridge 300 is also withdrawn. In this state, the user separates the cartridge 300 from the drawer 700. Subsequently, the user supplies water into the separated cartridge 300 through the water supply port, for example, the first filter 330, such that the cartridge 300 is filled with the water. After that, the user puts the cartridge 300, which is filled with the water, in the drawer 700, and then pushes the drawer 700 inward. As a result, the cartridge 300 is automatically coupled to the connection port 480, and therefore, the water in the cartridge flows toward the pump 400.

After the use of the drying machine is completed, the user may separate the cartridge from the drawer 700 in the reverse sequence. According to the present invention, the cartridge 300 includes the upper housing 320 and the lower housing 310. Consequently, it is easy and convenient to clean the separated cartridge 300.

Figure 11:
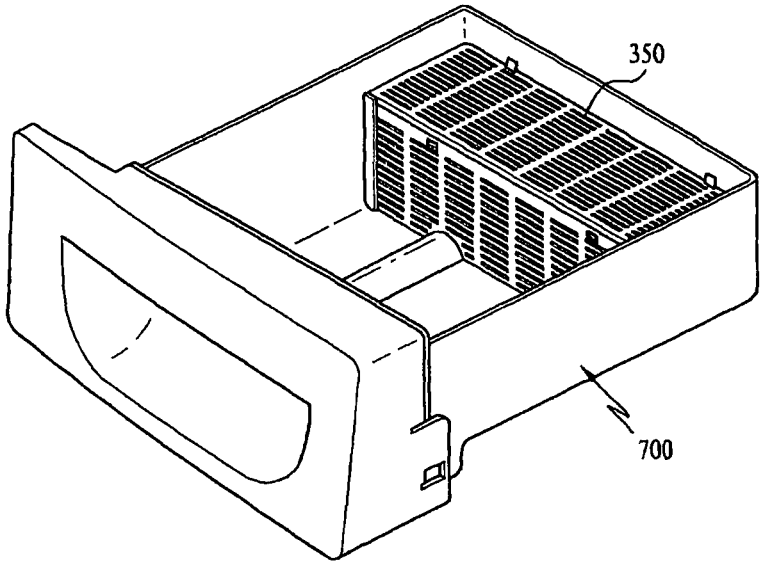
FIG. 11 is a perspective view illustrating another example of the water supply source of FIG. 4.

As shown in FIG. 11, on the other hand, the drawer 700 may be used as a directly detachable water supply source. When the drawer 700 is used as the directly detachable water supply source, however, water may overflow due to carelessness of a user during the supply of water to the drawer 700. This problem may be solved to some extent by using the cartridge 300 as the detachable water supply source. When the drawer 700 is used as the directly detachable water supply source, it is possible to simplify the structure of the drawer 700. FIG. 11 illustrates the water softening member 350 mounted in the drawer 700 for convenience of description. However, the present invention is not limited to this structure. For example, the first filter 300 and the second filter 340 may be also mounted in the drawer 700.

Hereinafter, a method of controlling the drying machine according to the present invention will be described with reference to FIGS. 12 and 13.

The method of controlling the drying machine according to the present invention includes a drum heating step (SS3) of heating the drum, a steam supply step (SS5) of supplying steam, generated by the steam generator, to the drum, and a hot air supply step (SS7) for supplying hot air to the drum. Preferably, a water supply step (SS1) is carried out before the drum heating step (SS3). Preferably, the control method according to the present invention further includes a cooling step (SS9) of cooling the drum, which is carried out after the hot air supply step (SS7).

Preferably, the control method according to the present invention further includes a water collection step of discharging water remaining in the steam generator, i.e., the remaining water in the steam generator, to the outside, which is carried out after the steam supply step (SS5). (The water collection step will be described hereinafter in detail.)

Now, the respective control steps will be described in detail.

The drum heating step (SS3) is a step of heating the drum to a predetermined temperature such that the removal of wrinkles on laundry can be more effectively performed at the next step, i.e., the steam supply step (SS5). The drum heating step (SS3) is carried out for a predetermined period of time (T_pre T_pump). At this time, the drum is preferably tumbled. The drum may be intermittently tumbled. Tumbling is rotating the drum at a speed of approximately 50 rpm or less. Tumbling is well known in the art to which the present invention pertains, and therefore, a detailed description thereof will not be given. Preferably, the drum beating step (SS3) is initiated at a point of time when the water level in the steam generator reaches a high water level after water is supplied to the steam generator for a predetermined period of time (T_pump). Also, the steam heater is preferably operated at a point of time when the drum heating step (SS3) is initiated. This is because steam is generated a predetermined period of time after the steam heater is operated. Also, the termination of the drum heating step (SS3) preferably coincides with a point of time when the steam is generated.

On the other hand, the drum heating may be accomplished by supplying hot air to the drum.

The steam supply step (SS5) is a step of supplying steam to the drum such that the removal of wrinkles on laundry is performed. The steam supply step (SS5) is carried out for a predetermined period of time (T_steam). At this time, the drum is preferably tumbled. More preferably, the drum is intermittently tumbled. The period of time (T_steam), for which the steam supply step (SS5) is carried out, is previously set through experiments based on a factor, such as the amount of an object to be dried. At the steam supply step (SS5), the water level in the steam generator is lowered. Consequently, water is preferably supplied to the steam generator when a low water level is detected. In this case, water may be continuously supplied to the steam generator until the high water level is detected. Preferably, however, water is supplied to the steam generator for a predetermined period of time before the water level in the steam generator reaches the high water level for example, approximately 3 seconds, so as to increase the heating efficiency. Also, it is preferable that tumbling at the steam supply step (SS5) is repeated intermittently and periodically, for example, approximately 3 seconds per minute.

The hot air supply step (SS7) is a step of supplying hot air, generated by the hot air heater, to the drum such that laundry, which may be slightly wetted by the steam, is dried again. The hot air supply step (SS7) is carried out for a predetermined period of time (T_dry). At this time, the drum is not tumbled. The period of time (T_dry), for which the hot air supply step (SS7) is carried out, is also previously set through experiments based on a factor, such as the amount of an object to be dried.

It is preferable to discharge the water remaining in the steam generator to the cartridge after the hot air supply step (SS7) is completed. At this time, the temperature of the remaining water in the steam generator is high. Consequently, the remaining water in the steam generator is not immediately discharged to the cartridge but the discharge of the remaining water in the steam generator is delayed for a predetermined period of time (T_delay). When the temperature in the steam generator is less than a predetermined temperature (Temp_crit), the remaining water in the steam generator is discharged to the cartridge. (The details will be described below.)

The cooling step (SS9) is a step of cooling an object to be dried, the temperature of which has been increased at the hot air supply step (SS7). The cooling step (SS9) is carried out for a predetermined period of time (T_cooling). At this time, the drum is not tumbled. The period of time (T_cooling), for which the cooling step (SS9) is carried out, is also previously set through experiments based on a factor, such as the amount of an object to be dried. Although cool air may be supplied to the drum at the cooling step (SS9), the temperature of the object is not relatively high. Consequently, the object may be left as it is for a predetermined period of time, which is simple but preferred.

Hereinafter, a method of controlling the pump according to the present invention will be described with reference to FIGS. 12 and 13.

The pump control method according to the present invention includes a water supply step (S100 and S200) of supplying water to the steam generator, which generates steam to be supplied to the drum, and a water collection step (S300) of collecting the water remaining in the steam generator. Of curse, the water supply step (S100 and S200) preferably includes an initial water supply step (S100) and a water level maintenance step (S200) of maintaining the water level in the steam generator. On the other hand, the water collection step (S300) is preferably carried alt by the pump. More preferably, the water is collected to the detachable water supply source, which is connected to the steam generator.

Now, the respective steps will be described in detail.

As described above, the water supply step (S100 and S200) preferably includes the initial water supply step (S100) and the water level maintenance step (S200) of maintaining the water level in the steam generator. The pump is rotated in a forward direction to supply water to the steam generator (S1). When the water level in the steam generator reaches a high water level (S3), the pump is stopped, and the steam heater is operated (S5).

As the steam heater is operated, water is heated to generate steam. With the discharge of the generated steam, the water in the steam generator is reduced. Consequently, the water level in the steam generator is detected, and, when the water level in the steam generator reaches a low water level, the pump is rotated in the forward direction to supply water to the steam generator (S9 and S11). At this time, as previously described, the water may be continuously supplied to the steam generator until the high water level is detected. Preferably, however, water is supplied to the steam generator for a predetermined period of time, for example, approximately 3 seconds, so as to increase the heating efficiency.

When a predetermined period of steam supply time (T_steam) has elapsed (S7), on the other hand, the steam heater is stopped (S13), and a predetermined period of time (T_delay) is delayed (S15). The reason why the predetermined period of time (T_delay) is delayed is to maximally lower the temperature of the remaining water in the steam generator. Subsequently, when the temperature in the steam generator is lower than a safety temperature (Temp_crit) (S17), the pump is rotated in the reverse direction for a predetermined period of time, for example, approximately 30 seconds, to collect the remaining water from the steam generator (S25). However, when the temperature in the steam generator is higher than the safety temperature (Temp_crit), the remaining water is not directly collected from the steam generator but safety measures are taken.

For example, it is determined whether the water level in the steam generator is lower than the high water level (S19). When it is determined that the water level in the steam generator is lower than the high water level, the pump is rotated in the forward direction for a predetermined period of time, for example, approximately 5 seconds, to supply water to the steam generator (S21). When it is determined that the water level in the steam generator is not lower than the high water level, on the other hand, the temperature in the steam generator is compared with the safety temperature (Temp_crit) (S23). When the temperature in the steam generator is lower than the safety temperature (Temp_crit) (S23), the pump is rotated in the reverse direction for a predetermined period of time, for example, approximately 30 seconds, to collect the remaining water from the steam generator (S25). When the temperature in the steam generator is higher than the safety temperature (Temp_crit), on the other hand, the procedure is ended without the rotation of the pump in the reverse direction to collect the remaining water from the steam generator (S27). Of course, the temperature in the steam generator may be compared with the safety temperature after a predetermined period of time is delayed, and, when the above-mentioned requirement is satisfied, the remaining water may be collected from the steam generator. Here, the safety temperature (Temp_crit) means the maximum temperature at which the reliability of the pump is maintained. For example, the safety temperature is approximately 60 degree.

Figure 12:
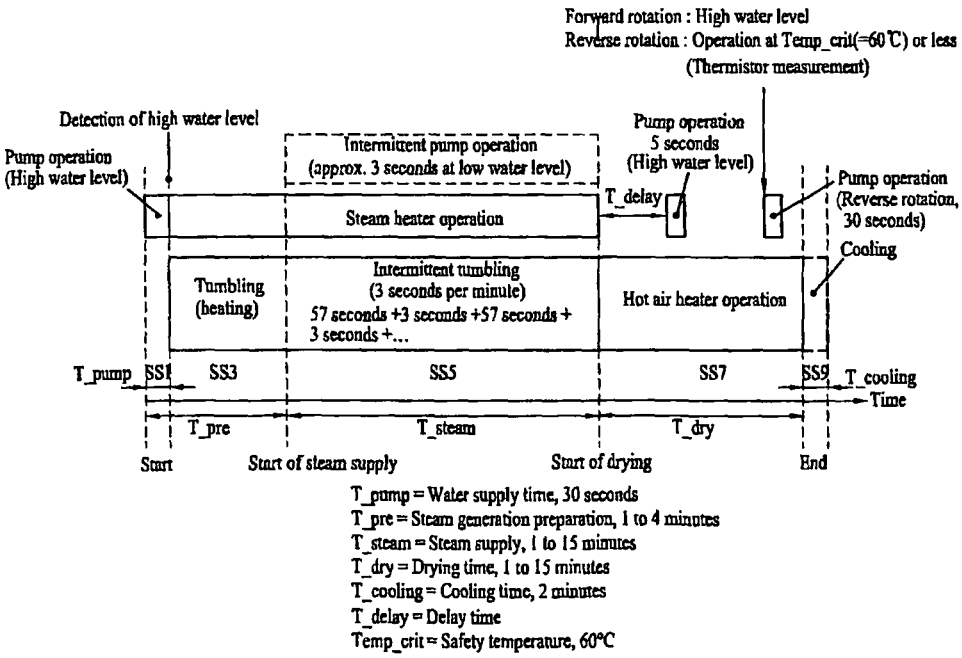
FIG. 12 is a view illustrating a method of controlling the laundry treating apparatus according to an embodiment of the present invention.
Figure 13:
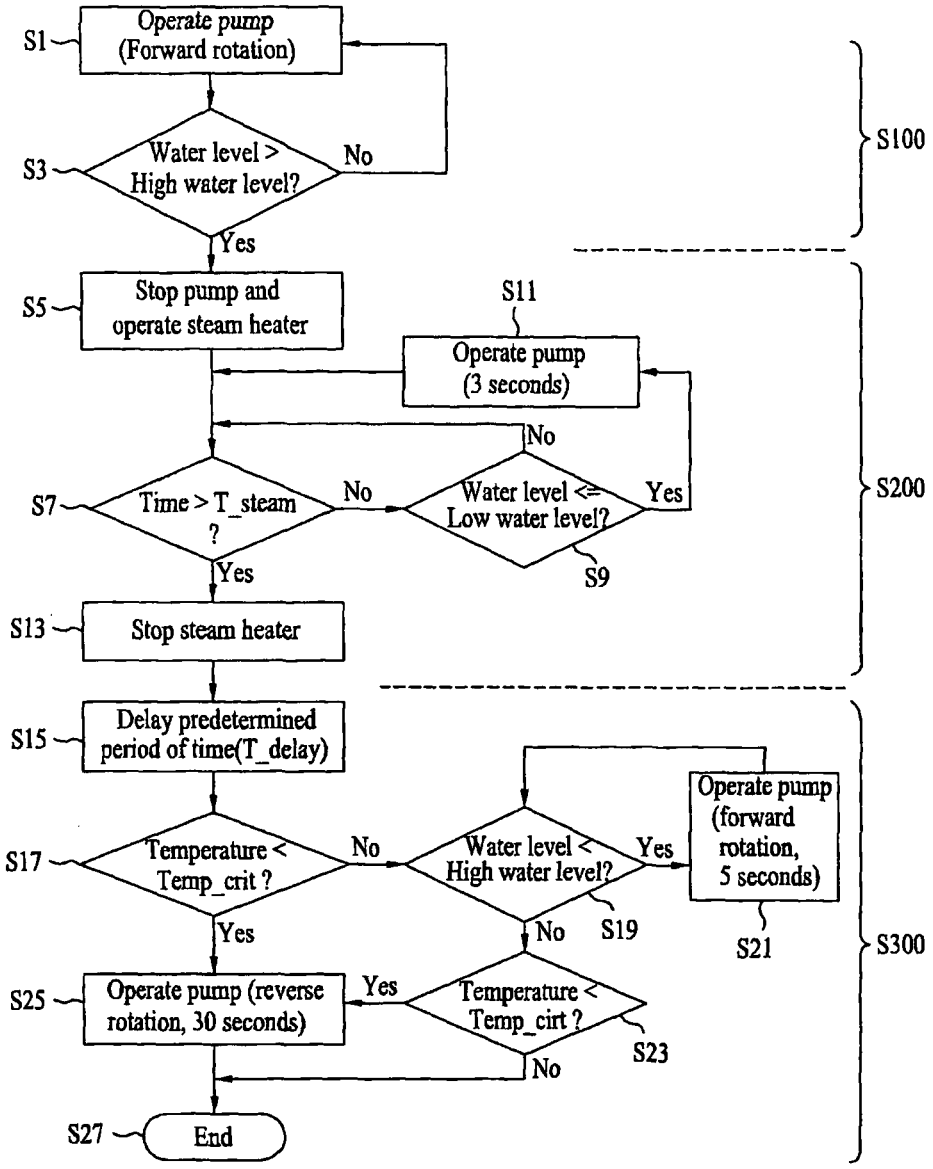
FIG. 13 is a flow chart illustrating a method of controlling a pump of FIG. 12.

The water supply time (T_pump), the steam generation preparing time (T_pre), the steam supply time (T_steam), the drying time (T_dry), the cooling time (T_cooling), the delay time (T_delay), the tumbling time, and the pump operating time, shown in FIGS. 12 and 13, are illustrative examples, and the above-specified times may be appropriately changed depending upon the capacity of the drying machine or the amount of an object to be dried.

The results of experiments carried out by the inventors of the present application revealed that the laundry treating apparatus according to the present invention had the effect of removing and preventing wrinkles on laundry although there was a difference depending upon the kinds of laundry, for example, the kinds of laundry materials, and the hygroscopic degree of the laundry. An example of an object to be dried may be laundry spin-dried by a washing machine. However, the object is not limited to the laundry. For example, the present invention is particularly useful when wrinkles on clothes worn approximately one day, i.e., the clothes which are already dried and a little wrinkled, are removed by the drying machine according to the present invention. In other words, the drying machine according to the present invention may be used as a kind of wrinkle removing apparatus.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

As apparent from the above description, the laundry treating apparatus, especially the laundry drying apparatus, and the method of controlling the same according to the present invention have the following effects.

First, the present invention has the effect of effectively preventing or removing rumples or wrinkles on a dried object. Also, the present invention has the effect of sterilizing the object and removing a smell from the object.

Secondly, the present invention has the effect of effectively removing rumples or wrinkles from dried laundry without additional ironing.

Thirdly, the present invention has the effect of effectively softening water to be supplied to the steam generator, thereby preventing the reduction in efficiency of the steam generator due to scale.

Fourthly, the present invention has the effect of allowing a user to easily infirm the replacement or regeneration time of the water softening member, thereby appropriately accomplishing the replacement or regeneration of the water softening member.

The invention claimed is:

1. A laundry treating apparatus comprising:
- a laundry receiving unit for receiving laundry;
- a steam generator for generating steam to be supplied to the laundry receiving unit;
- a water supply unit for supplying water to the steam generator;
- a water softening member for softening water to be supplied to the steam generator;
- a display unit to display a replacement or regeneration time of the water softening member; and
- a drawer provided at one side of a cabinet such that the drawer is selectively inserted into or pulled out from the cabinet,
- wherein the water supply unit comprises a water supply source detachably mounted in the drawer,
- wherein the water supply source comprises a lower housing for storing water and an upper housing detachably mounted to the lower housing; and
- wherein the water softening member is detachably disposed at the water supply source.

2. The laundry treating apparatus according to claim 1, wherein the replacement or regeneration time of the water softening member is decided based on a number of times water has been supplied to the steam generator.

3. The laundry treating apparatus according to claim 2, wherein the display unit displays at least one of the number of times water has been supplied to the steam generator, a remaining number of times water will be supplied to the steam generator, and a predetermined signal when the number of times water has been supplied to the steam generator exceeds a predetermined value.

4. The laundry treating apparatus according to claim 1, wherein the replacement or regeneration time of the water softening member is decided based on time.

5. The laundry treating apparatus according to claim 4, wherein the display unit displays at least one of a counted time, a remaining time, and a predetermined signal when a counted time exceeds a predetermined value.

6. The laundry treating apparatus according to claim 1, wherein the replacement or regeneration time of the water softening member is decided based on a number of times the steam generator has been operated.

7. The laundry treating apparatus according to claim 6, wherein the display unit displays at least one of the number of times the steam generator has been operated, a remaining number of times the steam generator will be operated, and a predetermined signal when the number of times the steam generator has been operated exceeds a predetermined value.

8. The laundry treating apparatus according to claim 1, wherein the display unit is initialized after a replacement or regeneration of the water softening member is completed.

9. The laundry treating apparatus according to claim 1, further comprising:
- a hardness sensor for sensing the hardness of water to be supplied to the steam generator,
- wherein a control unit controls to output a predetermined signal when the hardness of water sensed by the hardness sensor exceeds a reference value.

10. The laundry treating apparatus according to claim 9, wherein the hardness sensor is disposed between the water softening member and the steam generator.

11. The laundry treating apparatus according to claim 1, further comprising:
- a detection unit for detecting an accumulated amount of water supplied to the steam generator or a number of times water has been supplied to the steam generator,
- wherein a replacement or regeneration time of the water softening member is decided based on the accumulated amount of water or the number of times.

12. The laundry treating apparatus according to claim 11, further comprising:
- a gear pump disposed between the water supply unit and the steam generator for selectively supplying water to the steam generator,
- wherein the detection unit senses the number of rotations of a gear of the pump.

13. A laundry treating apparatus comprising:
- a laundry receiving unit for receiving laundry;
- a steam generator for generating steam to be supplied to the laundry receiving unit;
- a water supply unit for supplying water to the steam generator;
- a water softening member for softening water to be supplied to the steam generator;

a water softening detection unit for detecting whether water to be supplied to the steam generator has been softened;

a window for allowing a user to check a detection result; and a drawer provided at one side of a cabinet such that the drawer is selectively inserted into or pulled out from the cabinet, wherein the water supply unit comprises a water supply source detachably mounted in the drawer, wherein the water supply unit comprises a water supply source which is detachable, wherein the water supply source comprises a lower housing for storing water and an upper housing detachably mounted to the lower housing, and wherein the water softening member is detachably disposed at the water supply source.

14. The laundry treating apparatus according to claim 13, wherein the water softening detection unit is disposed between the water softening member and the steam generator.

15. The laundry treating apparatus according to claim 13, wherein the water softening detection unit is a PH sensor the color of which is changed depending upon the PH degree of water.

16. The laundry treating apparatus according to claim 13, further comprising:

a pump disposed between the water supply unit and the steam generator for selectively supplying water to the steam generator, wherein the water softening detection unit is disposed between the water softening member and the pump.

* * * * *